US005967369A

United States Patent [19]

Käfer et al.

[11] Patent Number: 5,967,369

[45] Date of Patent: Oct. 19, 1999

[54] DISPENSER FOR MEDIA HAVING MEASURED RESERVOIR

[75] Inventors: Stefan Käfer, Eigeltingen; René Bommer, Radolfzell, both of Germany

[73] Assignee: Ing. Erich Pfeiffer GmbH, Germany

[21] Appl. No.: 08/923,161

[22] Filed: Sep. 4, 1997

[30] Foreign Application Priority Data

Sep. 12, 1996 [DE] Germany ..... 196 37 101

[51] Int. Cl.[6] ..... B67D 5/00

[52] U.S. Cl. ..... 222/82; 222/321.2; 222/634

[58] Field of Search ..... 222/81, 82, 88, 222/386, 321.2, 634

[56] References Cited

U.S. PATENT DOCUMENTS

| | | | |
|---|---|---|---|
| 3,520,499 | 7/1970 | Ask | 244/77 |
| 4,017,007 | 4/1977 | Riccio . | |
| 5,337,740 | 8/1994 | Armstrong et al. | 128/203.12 |
| 5,469,989 | 11/1995 | Graf et al. | 222/82 |
| 5,683,361 | 11/1997 | Elk et al. . | |
| 5,813,570 | 9/1998 | Fuchs et al. | 222/82 |

FOREIGN PATENT DOCUMENTS

| | | | |
|---|---|---|---|
| 0 026 902 | 4/1981 | European Pat. Off. | B05B 7/04 |
| 0 407 276 A2 | 6/1990 | European Pat. Off. | A61M 11/00 |
| 0 407 276 | 1/1991 | European Pat. Off. . | |
| 546 607 A1 | 11/1992 | European Pat. Off. | B05B 11/02 |
| 1 145 560 | 3/1963 | Germany . | |
| 40 08 070 A1 | 9/1991 | Germany | B05B 1/00 |
| 40 27 320 A1 | 3/1992 | Germany | B65D 47/34 |
| 44 12 041 A1 | 10/1995 | Germany | B05B 11/02 |
| 1 488 719 | 10/1977 | United Kingdom . | |
| WO93 11818 | 6/1993 | WIPO . | |

*Primary Examiner*—Gregory L. Huson
*Attorney, Agent, or Firm*—Quarles & Brady

[57] ABSTRACT

A dispenser for handling media includes a base unit, a discharge actuator, a medium outlet, and a medium reservoir. The discharge actuator actuates the discharge of the medium, and the discharge actuator is convertable over an actuating stroke into varying actuating positions. The actuating positions include an initial rest position and an actuated end position. The medium outlet is for expelling the medium. The medium reservoir defines a measured content of medium to be discharged upon a single actuating stroke, and the medium reservoir includes an oblong hollow needle member for caching the medium to be discharged out of the medium outlet.

29 Claims, 1 Drawing Sheet

DISPENSER FOR MEDIA HAVING MEASURED RESERVOIR

TECHNICAL FIELD OF THE INVENTION

The invention relates to a device for discharging or distributing media which may be gaseous, liquid, pasty and/or powdery. The medium may be already atomized within the device upstream of the medium orifice or on leaving the latter so that even minute amounts of the medium form a very large effective surface area. The medium may be an active agent as used in pharmaceutical, cosmetic or technical products, which is discharged by a manual activation shortening at least part of the device so that it is totally released from the discharge device at the definition of the medium orifice.

For the medium, a reservoir is provided which as a dispensing chamber is filled already on production of the device, but which after each medium discharge can also be refilled from a main reservoir similiar to a pump chamber. Instead of a single reservoir several reservoirs, may be provided in sequence in a single axis and/or in a daisy-ring formation and discharged in sequence through the medium orifice by a sequence of actuating steps with pauses inbetween.

OBJECT OF THE INVENTION

The invention is based on the object of defining a discharge device for media which avoids the drawbacks of known configurations and with which, more particularly, even minute amounts of media can be reliably stored and discharged substantially without any remainder.

SUMMARY OF THE INVENTION

In accordance with the invention, a reservoir, or a space thereof receiving the medium features a very elongated shape, the width or diameter of which may amount to less than 5, 3 or 1 mm so that the medium, contained therein assumes the shape of a long pin or needle. The inner width of the reservoir may correspond to four or six times its wall thickness and the length of the reservoir space may correspond to four to six times its inner width. It being understood that these values may represent maximum and minimum values in each case. Expediently, the wall thickness is constant over the circumference and length of the reservoir body. The reservoir body may be formed simply by a section of a cylindrical hollow needle of a plastics, steel, such as stainless steel, transparent material, such as glass, or the like so that its production is very simple.

Irrespective of the configuration described, a body may be provided on a unit of the device, which is movable relative to the medium orifice for activating discharge. This body, in the course of the actuating movement, opening a closure of a chamber, e.g. by puncturing. The space within this chamber may directly adjoin the medium in the reservoir, accommodate the opening body or the reservoir at least in part and configured as a pressure space which prior to being opened is at an elevated pressure. The opening body may be formed directly by the reservoir.

It is advantageously provided for in the device, during a part of the actuating travel following the starting position that an elevated pressure is built up. This may act permanently also on the opposing sides of the medium in the reservoir so that the fluid medium initially executes no flowing movements relative to the reservoir. In a subsequent portion of the actuating movement continuing in the same direction, the medium is relieved of the pressure at one of the cited sides and conductingly communicated to the medium orifice on this side without any further interposed valve. As such, that due to the pressure acting, now as then, on the other side, the medium is instantly jetted from the reservoir and through the medium orifice.

It is particularly of advantage when the reservoir is arranged substantially totally and mostly without contact within a pressure or pumping chamber of a fluid pump, such as a gas or air pump. The reason being in at least one actuating position or in all actuating positions, one or more reservoir inlets for the fluid and/or a reservoir outlet located spaced away therefrom for the medium is/are connected to the pressure chamber or to the pressure existing therein. Then, in the course of the actuating movement, the reservoir or another puncturing spike may then puncture the movable chamber closure, for example a plunger, from within so that its reservoir outlet is located sealed outside of the pressure chamber and the fluid then flowing into the reservoir inlet forces the medium linearly through the reservoir outlet.

Both the medium and the fluid may be provided packaged sterile and closed off pressure-tight within a reservoir unit to be inserted into the base body. The base body comprising the medium orifice initially having no opening of the reservoir spaces into the starting position and subsequently to be emptied by actuation. For this purpose, the base body necessitates no member, such as a puncturing spike, a needle or the like, directly opening the closure, since this opening member is already a component of the reservoir unit.

Each of the two reservoirs, more particularly, the fluid reservoir, may also form a unit prefabricated with the base body and connected via a restraint firmly seated on the base body so that the reservoir is movable relative to the base body not before an actuating force is applied which is substantially greater than the actuating force to be subsequently applied via the remaining travel. As a result of this an actuating movement instantly commences which very quickly causes high flow rates of the medium or fluid and improves the atomization thereof. The restraint which may also be a snap-acting connection safeguarding against a return action is expediently formed by a design fracture point so that an integral configuration of the reservoir body with the base body is possible.

The medium reservoir may also be provided on a mounting body separate from the reservoir body for the fluid or from some other carrying body and form therewith a preassembled unit to be secured replaceably to the carrying body when the latter is in the starting position.

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILED DESCRIPTION OF THE PREFERRED EMBODIMENT

Figures 1, 2, 3:
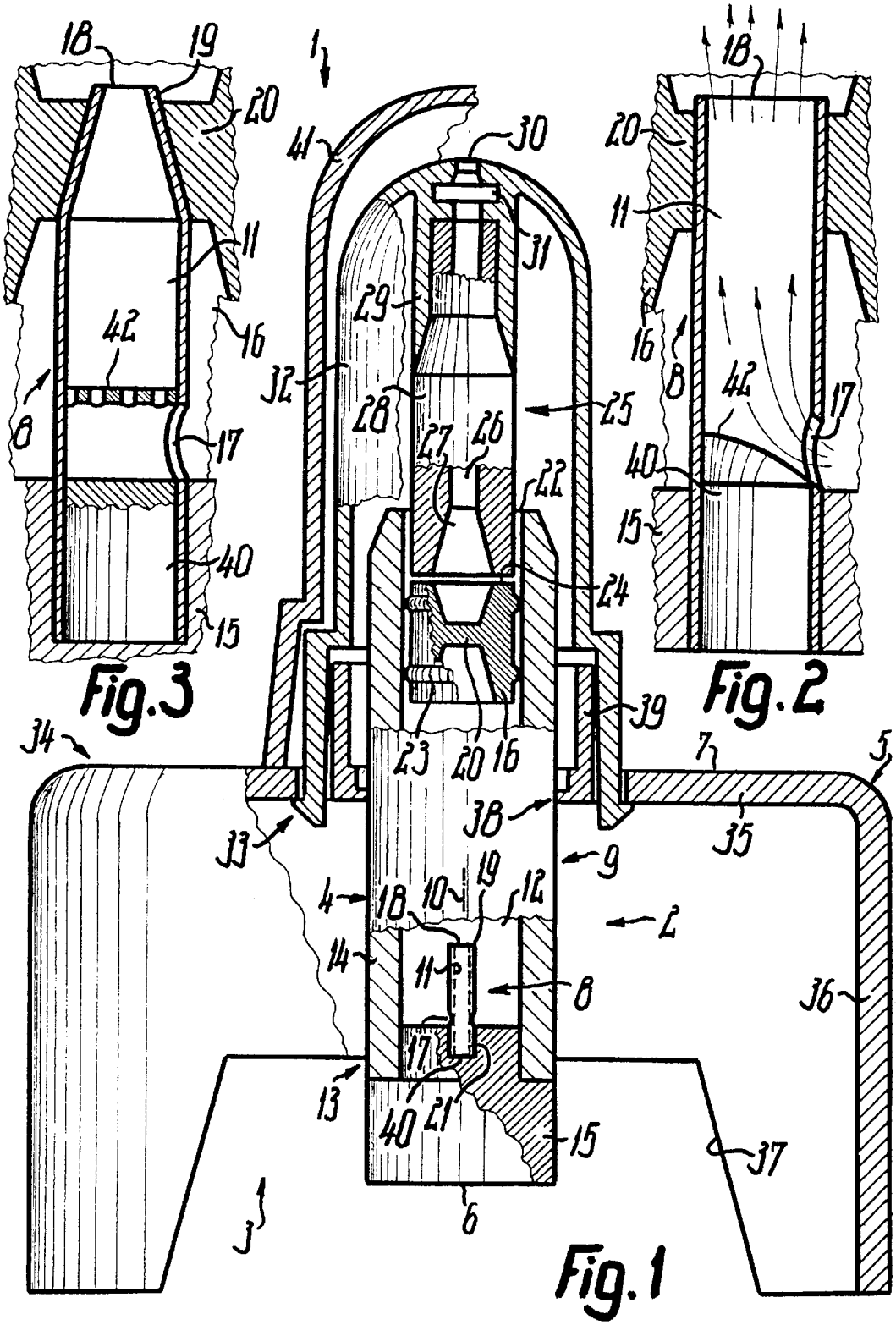
FIG. 1 is a partially sectioned view of a dispenser in accordance with the invention.
FIG. 2 is a section of the configuration as shown in FIG. 1 but on a magnified scale and slightly modified and FIG. 3 shows a further embodiment in an illustration corresponding to that of FIG. 2.

The dispenser 1 comprises two units 2, 3 arranged axially linearly counter shiftable, forming substantially the total device and of which the unit 2 may be located permanently totally within the unit 3 in all actuating positions. As the outermost, dimensionally rigid part, the unit 2 comprises a base body 4 and the unit 3 a base body 5, each of which is provided with an exposed handle 6, 7 for manual actuation. Provided totally within the base bodies 4, 5 and immediately adjacent to the handle 6 is a reservoir 8, namely a needle-thin tube which is located by the majority of its length non-contactingly within a reservoir 9 for a gaseous fluid. All components are provided in an axis 10 and, except for the bodies 5, 8 are rotationally symmetrical.

The tubular inner surface area of the reservoir 9 defines a cylindrical reservoir chamber 12 for a medium which like powder may be densely packed in the reservoir 8 so that its flowability as compared to its loose condition is substantially diminished. It being so viscous that without external influence it is unable to flow of its own accord. A chamber 12 larger in volume by at least a hundred times or two hundred times for the fluid forms the reservoir 9. Cross-sectionally, the chamber 12 is coaxially annular in the region of the reservoir 8, the circumference of which it adjoins. The base body 4 or another body is provided as the carrier body 13 for the reservoir 8 and sealingly closed at the base carrying the reservoir 8. The body 4, 13 comprises a tubular shell 14 having an inner and/or outer cross-section constant over its full length which may consist of a transparent material so that the reservoir 8 is visible radially from without. At the lower end of the shell 14, a closure/mounting body 15 is secured which is inserted firmly seated and sealed in the inner circumference of the shell 14 by a section maximally as long as its diameter and contacting via an annular shoulder the lower end surface area of the shell 14 by an outer end section. The outer circumference of which forms a continuation of the outer circumference of the shell 14 the same in width. The cover 15 could also be configured integral with the shell 14 or arranged replaceable by a snap-acting connection or the like.

Located spaced away from the bodies 8, 15 is a closure or piston 16 which in the starting position is located totally within the chamber 21 or the shell 14 and is spaced away from the upper end of the body 4, 13. The reservoir 8 comprises spaced away between its ends and nearer to the lower end than the reservoir inlet 17 several openings distributed about its circumference which pass through its shell transversely and each of which has a smaller width than the chamber 11. As viewed axially, the openings 17 may be circular or parallel to the axis 10 or extending elongated in the circumferential direction of the reservoir 8. The upper end, located at right angles transversely to the axis 10 throughout, of the reservoir 8 defines as the reservoir outlet 18 an opening the same in width as the reservoir space. This end of the reservoir shell forms an annular puncturing tip 19 the same in width as the remaining reservoir 8. The reservoir width being understood to be the inner and/or outer width of the reservoir 8.

Spaced away from and between its end surfaces areas, the piston 16 comprises in the center as a closure a circular disk-shaped diaphragm 20 or the like configured integral with the remaining piston 16 in a material which is softer and more elastic than the materials of the components 8, 14, 15. The diaphragm 20 forms the bottom surface area of two depressions opposingly flared at an acute conical angle. These depressions being largest in width in the face surface areas of the piston 16. The diameter of these bottom surface areas or of the diaphragm 20 may equal the outer width of the reservoir 8 or of the tip 19 or be slight larger relative thereto. When the piston 16 is moved by an actuating plunger or the like against the reservoir 8, the pressure increases in the chamber 12 until the end 19 has completely penetrated the diaphragm 20 without detaching particles and is located in the plunger of the upper face surface area of the diaphragm 20 totally within the piston 16. The piston 16 is then defined by abutment against the bottom surface area of the chamber 12 or the like. This flat bottom surface area which may be formed by the body 15 thus adjoins the lower definitions of the openings 17 and the outer circumference of the reservoir 8 tangentially so that the pressure in the chamber 12 is available in the openings 17 and at the opening 18. By its shorter lower end section directly adjoining the openings 17 as well as the reservoir space, the reservoir 8 is sealed in the chamber bottom firmly seated in a blind hole and inserted abutting by its end surface area so that it does not depart from the pressure by the piston 16 and the diaphragm 20. The width of the reservoir 8 is smaller than half, a third or a quarter of the width of the chamber 12.

The reservoir 8 and the piston 16 may be inserted at the lower or upper end into the shell 14 so that an elevated pressure exists in the chamber 12 already after assembly and in the starting position. In the case of the opening 22 of the chamber 12 remote from the body 15 the shell 14 may be conically tapered at an acute angle at the outer circumference of its corresponding end section. The piston 16 is sealingly guided at the inner circumference of the shell 14 defining the chamber 12 by two annular sealing lips 23 with radial pretension. These sealing lips being axially curved partly circular in shape, located each in the region of one of the depressions spaced away from each other axially, from the ends of the piston 16 as well as from the diaphragm 20 and contacting the inner circumference of the chamber 12 linearly in the middle of the axial extent of their translation into the piston circumference. In the starting position the upper end surface area 24 of the piston 16 is set back relative to the opening 22 or the corresponding end surface area of the shell 14 by at least half the length of the piston 16. The unit 2 including reservoir 8, body 15 and piston 16 may be preassembled with the reservoir fillings and then releasably secured to the unit 3.

By means of an optional hollow actuating plunger 25 insertable through the opening 22, the unit may be secured also without unit 3 and the medium thus discharged from the end of the plunger 25 remote from the piston 16. The plunger 25 could also form an assembly integral with or preassembled with the piston 16 and freely protrude from the opening 22 in the starting position. In this case the plunger 25 is connected to the unit 3 or base body 5 positionally located by its flat lower end surface area in the starting position at the end surface area 24 merely spaced away therefrom by a gap. The outer width of the plunger 25 equals the outer width of the piston 16 adjacent to the seals 23 so that the plunger 15 permanently engages the shell 14 and the unit 2 are guided radially on each other with minimum radial clearance.

The plunger 25 located, like the piston 16 and the closure 20, in the axis 10 is penetrated over its full length by an outlet passage 26 which it defines over its full length and its full circumference integrally. A lower end section 27 of the passage 26 is flared downwardly at an acute angle to a width corresponding to the largest width of the corresponding depression in the end surface area 24 and may be equal to its length. The conical section 27 serves to accelerate the flow of the fluid medium mix on leaving the outlet 18 or the depression in the end surface area 24.

The longest portion of the passage 26 adjoining the piston 16 is provided in a plunger spike separate from the base body 5. The upper end of the spike offset in the outer width being inserted firmly seated in a sleeve-shaped plunger mount 29. Outside of the mount 29, the spike 28 features the same outer width as the latter. The mount 29 is shorter than the spike 28 or half of the length of the spike, this spike abutting by its upper end within the mount 29 axial against an annular bottom surface area. The latter is penetrated by a continuation of the cylindrical portion of the passage 26 constant in width. This continuation merging in the medium orifice 30 with interposition of a flared chamber or swirler 31. In the swirler 31 the medium is swirled or caused to rotate about the nozzle axis 10 of the atomizing nozzle 30 so that the fluid/medium mix emerges by the action of this swirl flow atomized from the nozzle 30 having a width of less than one or half a millimeter. The upper end of the spike 28 could also adjoin the swirler 21 or the swirl chamber thereof.

The outlet nozzle 30 is provided at the upper end of a port 32 the barreled or spherically curvature of which passes through the outlet nozzle at the convex outer side. This port being suitable for inserting into a bodily opening, for example, a nostril. The shell of the port 32 configured integral with the end wall. The mount 29 surrounds the plunger 25 over its full length and the body 4, 13 over part of its length circumferentially with radial spacing since the mount 29 protrudes freely from the inner side of the end wall against the body 4, 13 and in the starting position does not extend up to the opening 22, whereas in the end position on pumping it protrudes thereinto. With the mount 29, the port 32 is a one-piece component separate from the body 5. This component being arranged firmly seated on the body 5 via a connection such as a snap-acting connection. The port 32 could also be configured integral with the body 5.

The body 5 is formed substantially by a cap 34. The cap 34 having a face end wall 35 elongated axially from which a cap shell 36 protrudes oriented downwardly only and the outer side of which forms the likewise elongated handle 7. The face end wall 35 is penetrated by connecting or snap-action members at the lower end of the shell of the port 32. These members positively adjoining the inner side of the face end wall 35. The shell 36 could also be eliminated so that the part 34 is formed only by the face end wall 35 beyond the underside of which the unit 2 and a restraint 38 protrudes in each position. In the lower edge of the shell 26, at least one scallop 37 passing through the latter is provided for engaging the thumb of the user, since the handle 6 formed from the outer side of the body 15 including the longitudinal section of the unit 2 adjoining the port 32 is located in every position totally within the cap 34. The scallop 37 is provided in one or both of the longer sides of the oval or elliptical shell 36 as viewed axially like the handle 7.

In the starting position the unit 2 or its cited components are interconnected to the unit 3 via the restraint 38 which may be located in the plane of the face end wall 35 or spaced away therefrom below. This restraint could engage the outer circumference of the body 4, 13 with a spacing between the ends or the like in a spring latching action with increased friction via a design fracture point or the like. When the restraint 38 is overcome by the discharge actuation the force of the restraint is instantly cancelled and the units 2, 3 can be shifted relative to each other up to the stop of the piston 16 or the like with substantially enhanced ease of movement. Protruding beyond the outer side of the face end wall 35 and the handle 7 into the port 32 is a sleeve-shaped apron 39 radially spaced away within the outer circumference of the handle 7. This apron 32 may be configured integral with the body 5 and surrounds the body 4, 13 at the outer circumference with radial spacing as well as with a spacing from the ends thereof. At this apron 39, the port 32 may be radially centered or guided, as a result of which its snap-action members are locked in the latching position.

When not needed the port 32 may be totally covered by a snap-acting cap 41 which closely surrounds the port 32, extending up to the handle 7 and covering the nozzle 30.

For commencing operation the cap 41 locked in place by friction or spring latching action is removed. With the thumb within the cap 34 against the handle 6 and with further fingers of the same hand on both sides of the port 32 an increasing force is applied in the counter direction against the handle 7 until the restraint 38 is released. As a result of this the end of the plunger 25 is accelerated abruptly against the end surface area 24, without contacting the diaphragm 20 so that in further travel the piston 16 is moved against the body 8 and the cutter 19 with the diaphragm 20 closed to boost the pressure in the chamber 12. As soon as the lower face surface area of the diaphragm 20 comes up against the cutter 19, the latter begins to penetrate the diaphragm 20 until it protrudes only slightly beyond the upper face surface area of the diaphragm 20 so that it is only the inlet 17, but not the outlet 18, that is still located in the chamber 12.

It is through the outlet 18 now located outside of the chamber 12 and within the upper depression of the piston 16 that the medium is transported into this depression and then into the passage section 27 since the fluid is urged from the chamber 12 through the inlet 12 at the lower end of the medium fill into the chamber 11 and then with mixing of the medium is urged upwards in the direction of the discharge from the nozzle 30 to tear away from the chamber 11 directly into the linear passage 26, 27 to be transported with no further deflection into the flow means 31 or nozzle 30. After the piston 16 is stopped by the bottom of the chamber 12 the inlet 17 is located within the space formed by the lower piston depression. If in this arrangement this space is sealed off by the face surface area or stop spaced away of the piston 16 relative to the chamber 12 then the fluid flow is instantly interrupted. This space may also remain connected to the chamber 12 so that fluid is entrained from the latter until pressure equalization occurs and the chamber 11 as well as the passages 26, 27, 30, 31 are totally blown free of medium.

In this mutual end position of the units 2, 3, the handle 6 has practically attained the lower inner side of the face end wall 35. When a separate configuration is provided, the piston 16 is then no longer re-retractable with the plunger 25 due to the engagement of the piston 16 with the body 8 forming a non-return lock. The unit 2 can nevertheless be drawn downwards from the plunger 25 and pulled out of the cap 34 and the port 32 as well as replaced by a new unit 2, where necessary. When the piston 16 is connected to the plunger 25, the latter could execute a return stroke into the starting position as a result of which the chamber 12 could be refilled with air through a suitable valve-controlled inlet. The port 32 is fitted to cap 24 and the body 4, 13 from the outer side, namely from the handle 7. All components, where necessary, except for the reservoir 8, consist of a plastics material and may be fabricated as injected molded items.

The lower end of the reservoir 8 or of the chamber 11 is closed off pressure-tight by a closure 40 which as shown in FIG. 1 may be configured integral with the closure 15 and expediently extends up to the vicinity of the inlet 17. For example the lower end of the shell 8 may act as a cutter when the reservoir 8 in assembly is forced axially into the body 15 as well as thus being defined solely by friction at the inner and outer circumference, the portion of the bottom 15 located within the cutter entering into the reservoir 8 as the closure 40.

The axis of the opening 17 in each case may be located as shown in FIG. 1 at right angles to the axis 10. It may, however, also be located at an acute angle to the axis 10 as shown in FIG. 2 in the discharge device. This applies also to bottom surface area 42 of the reservoir space formed by the closure 40, remote from the outlet 18 and tangentially adjoining the definition of the opening 17. This bottom surface area may be curved barrel-shaped or convex. As shown in FIG. 2 the closure 40 is formed by a component located separate from the closure 15, located totally within the reservoir 8 so that the closure 40 may be preassembled with the reservoir 8 and the latter then connected to the body 13 or bottom 15. The bottom 14 may be located totally within the shell 14 and its lower end surface area mounting body provided with that of the shell 14 or of the reservoir 8 in a single plane.

As shown in FIG. 3, the bottom 42 of the reservoir space is formed by a sieve through which the fluid flows in the direction of discharge so that the medium in the reservoir does not close off the opening 17 like the opening 18 as in the embodiments as shown in FIG. 1 and FIG. 2. Instead the inlet 17 between closure 40 and the bottom 42 ports into an intermediate space free of medium which is located totally within the tube 8. The upper end of the tube 8 is in this case tapered conically at an acute angle so that the outlet 18 and the tip 19 or more restricted than the reservoir bottom 42 or the remaining tube 8. The closure 40 may be configured integral with the tube 8 e.g. by the low tube end being closed off by being radially nipped, angled or the like.

All features of all embodiments may be combined with each other e.g. so that each feature may be provided in each embodiment. All cited effects and properties may be provided precisely as cited, merely roughly so or substantially as stated or greatly departing therefrom.

We claim:

1. A dispenser for handling media comprising:

a base unit;

a discharge actuator for actuating discharge of the medium, said discharge actuator convertable over an actuating stroke into varying actuating positions, said actuating positions including an initial rest position and an actuated end position;

a medium outlet for expelling the medium, and a medium reservoir defining a measured content of medium to be substantially entirely discharged upon a single one of said actuating stroke, wherein said medium reservoir includes an oblong hollow needle member for caching the medium to be discharged out of said medium outlet.

2. The dispenser according to claim 1, wherein said medium reservoir includes a reservoir outlet located upstream of said medium outlet, said medium reservoir including a reservoir inlet located upstream of at least one of said medium outlet and said reservoir outlet.

3. The dispenser according to claim 1, further comprising a substantially closed chamber, said medium reservoir substantially freely projecting inside said closed chamber.

4. The dispenser according to claim 1, further comprising means for admixing a fluid into the medium.

5. The dispenser according to claim 1, further comprising propellant means for conveying the medium.

6. The dispenser according to claim 1, further comprising a pressure pump for conveying a fluid inside said medium reservoir.

7. The dispenser according to claim 1, further comprising pressurizing means for externally pressurizing said medium reservoir.

8. The dispenser according to claim 7, wherein said medium reservoir includes at least one restricted passage, said pressurizing means for pressurizing the medium through said restricted passage.

9. The dispenser according to claim 1, wherein said medium reservoir includes passages, said passages including a reservoir inlet and a reservoir outlet, control means being included for primarily pressurizing and then depressurizing said reservoir outlet while simultaneously pressurizing said reservoir inlet.

10. The dispenser according to claim 1, further comprising a valve, said valve including said medium reservoir.

11. The dispenser according to claim 10, wherein said valve includes a valve body and said medium reservoir includes an outlet end providing said valve body, said medium reservoir being closed off pressure-tight with respect to said medium outlet when in said rest position relative to said medium outlet.

12. The dispenser according to claim 1, further comprising:

a separation, and piercing means for piercing said separation with said discharge actuator.

13. The dispenser according to claim 12, wherein said piercing means include first and second piercing members, said first piercing member being operationally displaceable with respect to said second piercing member, said second piercing member including said separation, said medium reservoir including said first piercing member.

14. The dispenser according to claim 12, wherein said separation is operationally substantially stationary with respect to said medium outlet.

15. The dispenser according to claim 12, further comprising a pressure chamber, said medium reservoir is substantially permanently ductively connected with said pressure chamber bounded by said separation.

16. The dispenser according to claim 12, further comprising a slide member, said slide member includes said separation and defines remote slide member ends, said separation being spaced from at least one of said slide member ends.

17. The dispenser according to claim 1, further comprising a support unit separate from said medium reservoir, said support unit substantially stationarily and permanently holds said medium reservoir.

18. The dispenser according to claim 17, wherein said medium reservoir is substantially entirely and radially spacedly located within said support unit, said support unit including a support wall, said medium reservoir including an end section countersunk within said support wall.

19. The dispenser according to claim 17, wherein said support unit envelops a substantially closed chamber and includes at least one chamber closure and a chamber wall oriented transverse to said chamber closure, said base unit including a first assembly unit and a second assembly unit displaceable with respect to said first assembly unit with said discharge actuator, said first assembly unit including said chamber wall, said at least one chamber closure and said medium reservoir independent from said second assembly unit.

20. The dispenser according to claim 17, further comprising a thrust piston pump, said support unit envelops said thrust piston pump, said thrust piston pump including a pump piston, said pump piston being cross-sectionally wider than said medium reservoir.

21. The dispenser according to claim 1, wherein said base body includes an actuating ram bounding an outlet duct and movable with said discharge actuator relative to said medium reservoir, said actuating ram freely projecting from a ram end and defining a cross-sectionally greatest external ram width extension, said medium reservoir bounding a reservoir space defining a cross-sectionally greatest internal reservoir width extension, said ram width extension being multiply larger than said reservoir width extension.

22. The dispenser according to claim 1, further comprising a displacement piston and an actuating ram for manually conveying the medium and for pushing said displacement piston, said displacement piston defines an actuating end, when in said initial rest position said actuating ram extending substantially up to said actuating end without said actuating ram internally non-contactingly engaging said displacement piston.

23. The dispenser according to claim 22, wherein said actuating ram is permanently entirely located outside said displacement piston.

24. The dispenser according to claim 1, further a slendered discharge socket and two remote actuating handles to be axially narrowed over said actuating stroke, said actuating handles including a first handle and a second handle, said medium outlet is commonly displaceable with said second actuating handle, when in said initial rest position said medium reservoir being axially spaced from at least one of said second actuating handle and said discharge socket, said discharge socket providing a component separate from said second actuating handle.

25. The dispenser according to claim 1, further comprising:

a support body commonly displaceable with said medium reservoir over said actuating stroke and including a support component separate from said medium reservoir, and a base body, commonly with said medium outlet said base body being displaceable with respect to said medium reservoir over said actuating stroke, said support component including a first actuating handle and said base body including a second actuating handle located and oriented remote from said first actuating handle, said base body being made in one part with said support component.

26. The dispenser according to claim 25, wherein said discharge actuator includes a manually overcomeable stoppage, said stoppage including a breaking point that breaks upon simultaneously actuating said first and second actuating handles, said breaking point connecting said base body in one part with said support component.

27. The dispenser according to claim 1, wherein said medium reservoir is bounded by a reservoir jacket traversed by a duct passage.

28. The dispenser according to claim 1, wherein said medium reservoir is a cannula needle.

29. The dispenser according to claim 1, wherein said medium reservoir includes non-plastic material including metallic material.

* * * * *